US006801563B2

(12) United States Patent
Stercho

(10) Patent No.: US 6,801,563 B2
(45) Date of Patent: Oct. 5, 2004

(54) APPARATUS TO MANIPULATE SCRAP IN A SCRAP CHARGER

(75) Inventor: Michael J. Stercho, Wexford, PA (US)

(73) Assignee: SMS Demag, Inc., Pittsburgh, PA (US)

( * ) Notice: Subject to any disclaimer, the term of this patent is extended or adjusted under 35 U.S.C. 154(b) by 0 days.

(21) Appl. No.: 10/039,672

(22) Filed: Nov. 7, 2001

(65) Prior Publication Data

US 2003/0086469 A1 May 8, 2003

(51) Int. Cl.[7] ..... F27D 3/00
(52) U.S. Cl. ..... 373/79; 373/81
(58) Field of Search ..... 373/79–82, 102; 110/229, 238, 242, 250, 255; 432/109, 239, 243; 266/44, 142, DIG. 1; 75/10.66; 414/148, 194, 208, 167; 423/160, 442; 193/21; 222/556

(56) References Cited

U.S. PATENT DOCUMENTS 1,338,881 A * 5/1920 Stock ..... 373/79
1,422,135 A * 7/1922 Rogatz ..... 373/79
3,499,557 A * 3/1970 Walzel ..... 414/208
4,423,514 A * 12/1983 Davene ..... 373/79
6,155,182 A * 12/2000 Tsangaris et al. ..... 110/255
6,389,054 B1 * 5/2002 Stercho ..... 373/81
6,450,804 B2 * 9/2002 Vallomy ..... 432/239
6,473,446 B2 * 10/2002 Stercho ..... 373/78
6,521,170 B2 * 2/2003 Stercho ..... 266/44
2002/0110175 A1 * 8/2002 Stercho ..... 373/79

* cited by examiner

*Primary Examiner*—Tu Ba Hoang
(74) *Attorney, Agent, or Firm*—Clifford A. Poff

(57) ABSTRACT

A scrap charging apparatus for an electric arc furnace includes a scrap holding bunker having diverging side walls extending between end walls separated by a scrap discharge opening supplying scrap from a fall space in the bunker to a scrap discharge chute. The end wall remote to the scrap discharged opening of the chute slopes at an acute angle to organized scrap entering the discharged opening. A throat opening for scrap passing into the scrap discharge chute is controlled by a pivotal scrap jam relief gate moveable between a scrap metering position, a relief position and a scrap compacting position.

18 Claims, 6 Drawing Sheets

APPARATUS TO MANIPULATE SCRAP IN A SCRAP CHARGER

CROSS REFERENCE TO RELATED APPLICATIONS

The present invention is related to patent application Ser. No. 09/737,440 filed Dec. 13, 2000 entitled Electric furnace for steel making; Ser. No. 09/738,095 filed Dec. 16, 2000 entitled Revamping of a basic oxygen furnace installation to provide an electric furnace facility; and Ser. No. 09/739,851 filed Dec. 18, 2000 entitled Scrap charger.

BACKGROUND OF THE INVENTION

1. Field of the Invention

The present invention relates to a scrap charger designed to manipulate scrap during conveyance to an electric furnace used in a steel making process and, more particularly, to the construction of such a scrap charger to promote an organized flow of scrap from a storage bunker into a scrap delivery chute communicating with an electric arc furnace.

2. Description of the Prior Art

It is known in the art to supply scrap to steel making furnaces by diverse modes of transportation. A furnace such as a basic oxygen furnace may receive a scrap charge transported by an overhead crane in a scrap bucket. To lessen the demand for an overhead crane, a conveyor or sequentially arranged conveyors can be used to convey scrap to the furnace, but the conveyor installation occupies space in the facility which can be extensive along a course that becomes congested in and about the site of the steel making furnace. Rail cars may be used to shuttle scrap buckets between a scrap storage area and the steel-making furnace for the charging of scrap. Other steel making furnaces such as an electric arc furnace may directly communicate utilize a scrap charger to supply scrap from an integral scrap storage bunker or hopper.

In my patent application Ser. No. 09/739,851, there is disclosed a scrap charging apparatus for an electric arc furnace using diverging end walls extending between converging side walls of a scrap holding bunker to provide an impetus in the bunker for scrap flow to an underlying scrap delivery chute. The scrap delivery chute includes an elongated scrap-carrying trough having a greater width than the exit width for scrap from the scrap holding bunker. A ram is controlled by a drive to incrementally advance scrap along the scrap delivery chute for introducing successive preselected volumes of scrap to a charging opining for an electric arc furnace. The scrap holding bunker and scrap delivery chute are engaged and supported by a superstructure at an elevated and lateral spaced location from the electric arc furnace. The scrap-carrying trough terminates with the provision of a water-cooled trough section that is extendable through a charging opening in an upper furnace wall of the electric arc furnace for charging scrap and retracted for servicing of the furnace. The present invention seeks to alleviate the possibility of a scrap jam occurring in the vicinity of the transition of scrap flow from a generally vertical flow to a generally horizontal flow and which can be adversely influenced by the superimposed weight of the column of scrap bounded by the diverging end walls and converging side walls of a scrap holding bunker.

It is an object of the present invention to provide a transport vehicle constructed for displacing a scrap charger supported thereon between a scrap charging position wherein a horizontal scrap deliverly chute extends into an electric arc furnace for the charging of scrap and an inoperative position wherein the scrap delivery chute is remotely spaced from the electric furnace to allow servicing of the electric arc furnace and or tapping of a melt from the furnace.

It is another object of the present invention to provide a scrap charger to maintain a flow of scrap particularly in an area of transition underneath a storage bunker where the scrap must advance from a generally vertical columnar flow to a generally horizontally subdivided fraction advanced intermittently along a generally horizontally extending delivery chute communicating with an electric arc furnace.

It is a further object of the present invention to provide a scrap charger construction to enable subdividing layers of scrap in such a fashion that a scrap advancing force by a ram always remains sufficient to move the scrap through a throat opening into the horizontal feed chute by controlling the size of the throat opening.

It is a further object of the present invention to provide a scrap charger to maintain a flow of scrap particularly to an area of transition underneath a storage bunker where the scrap must advance from a generally vertical columnar flow to a generally horizontally subdivided fraction by providing the storage bunker with an elongated end wall section inclined to the horizontal at an acute angle selected to utilize the force of gravity to advance scrap laterally into the generally vertical columnar flow of scrap and thereby reduce the compacting forces arising out of the height of the scrap column in the storage bunker.

BRIEF SUMMARY OF THE INVENTION

According to the present invention there is provided a scrap charging apparatus for an electric arc furnace, the scrap charging apparatus including the combination of a scrap holding bunker having a scrap fall space extending to an underlying scrap discharge opening, a scrap delivery chute including a generally horizontal feed chute section having a scrap jam relief gate at a throat opening for receiving scrap from the scrap discharge opening, the scrap jam relief gate being displaceable between an operating position establishing a desired flow of scrap passing the throat opening from the scrap holding bunker and a second position for passage of scrap impeded by the scrap jam relief gate at the operating position, and a ram controlled by a drive to advance scrap from the scrap discharge opening through the throat opening for delivery from the scrap delivery chute.

According to a further aspect of the present invention there is provided a scrap charging apparatus for an electric arc furnace, said scrap charging apparatus including the combination of a scrap holding bunker having a scrap fall space bounded by spaced apart side walls and a front end wall spaced by a scrap delivery opening from a back end wall and the back end wall essentially including an elongated inclined wall section sloping to the horizontal toward the scrap delivery opening at an acute angle sufficient in magnitude for utilizing the force of gravity to promote lateral advancing movement of scrap along the elongated inclined wall section into the scrap delivery opening and thereby reduce vertical loading on scrap entering the scrap discharge opening, a scrap delivery chute including a generally horizontal elongated feed chute section extendable through a charging opening of an electric arc furnace for charging of scrap received from the scrap discharge opening, and a ram controlled by a drive to advance scrap from the scrap delivery chute into the electric arc furnace.

According to a still further aspect of the present invention there is provided a scrap charging apparatus for an electric arc furnace, the scrap charging apparatus including the combination of a scrap holding bunker having a scrap fall space extending to an underlying scrap discharge opening, a scrap delivery chute including a generally horizontal elongated feed chute section extendable through a charging opening of an electric arc furnace for charging of scrap received from the scrap discharge opening, a transport vehicle supporting the scrap delivery chute for movement between a scrap charging position wherein the generally horizontal elongated feed chute section extends through a charging opening into an electric arc furnace and an inoperative position, with or without corresponding movement of the scrap holding bunker, wherein the horizontal elongated feed chute section is withdrawn from the charging opening for taping of the electric arc furnace, a structure for supporting the transport vehicle at a laterally spaced location from the electric arc furnace, and a ram controlled by a drive to advance scrap from the scrap delivery chute into the electric arc furnace.

BRIEF DESCRIPTION OF THE SEVERAL VIEWS OF THE DRAWINGS

The present invention will be more fully understood when the following description is read in light of the accompanying drawings in which.

DETAILED DESCRIPTION OF THE INVENTION

Figure 1:
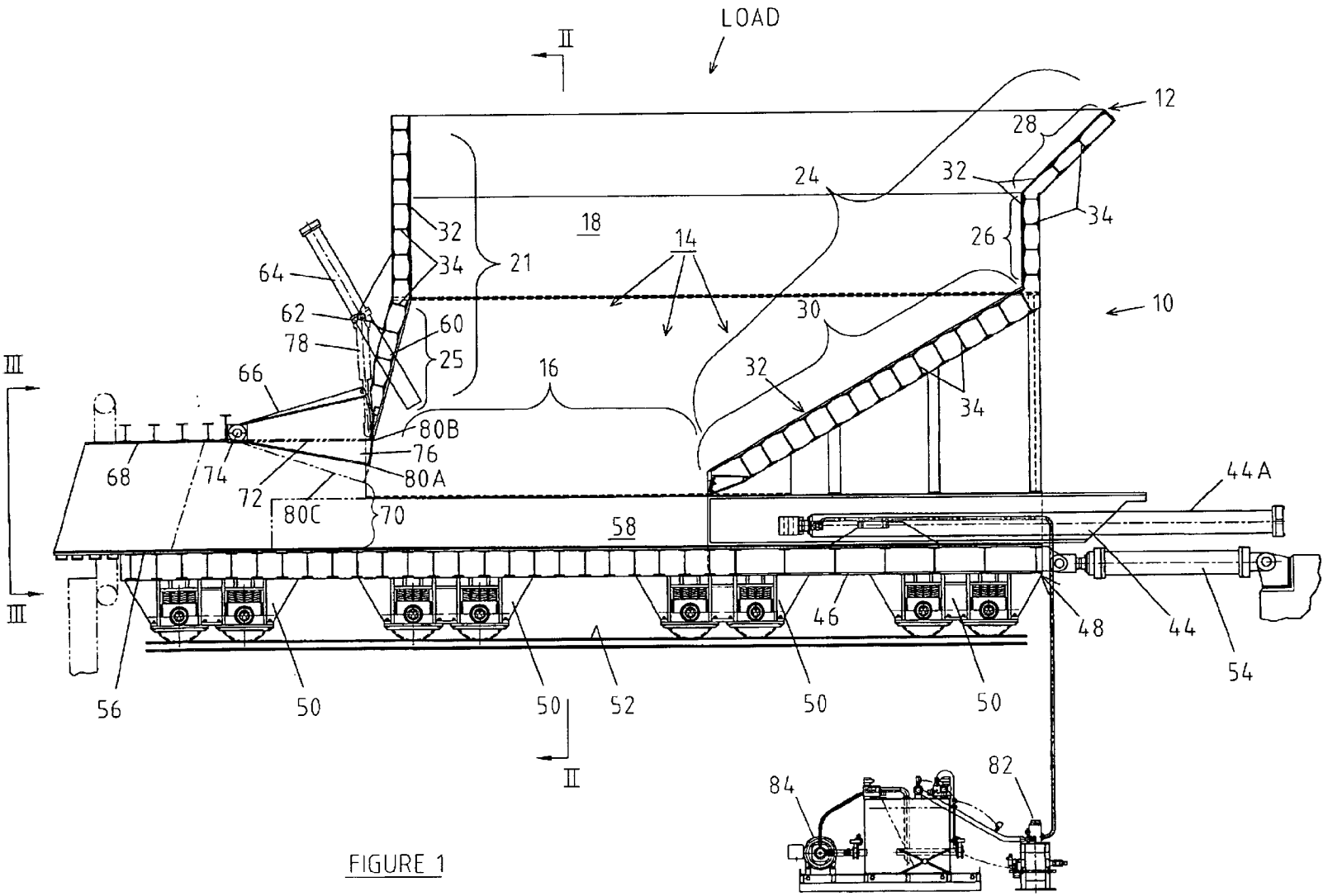
FIG. 1 is a side elevational view in section of a scrap charger according to the preferred embodiment of the present invention.
Figure 3:
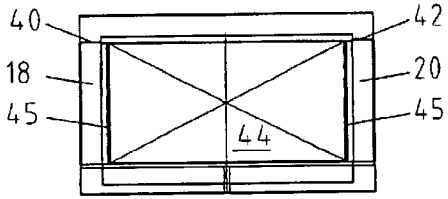
FIG. 3 is a front elevational view taken along lines III—III of FIG. 1.
Figure 2:
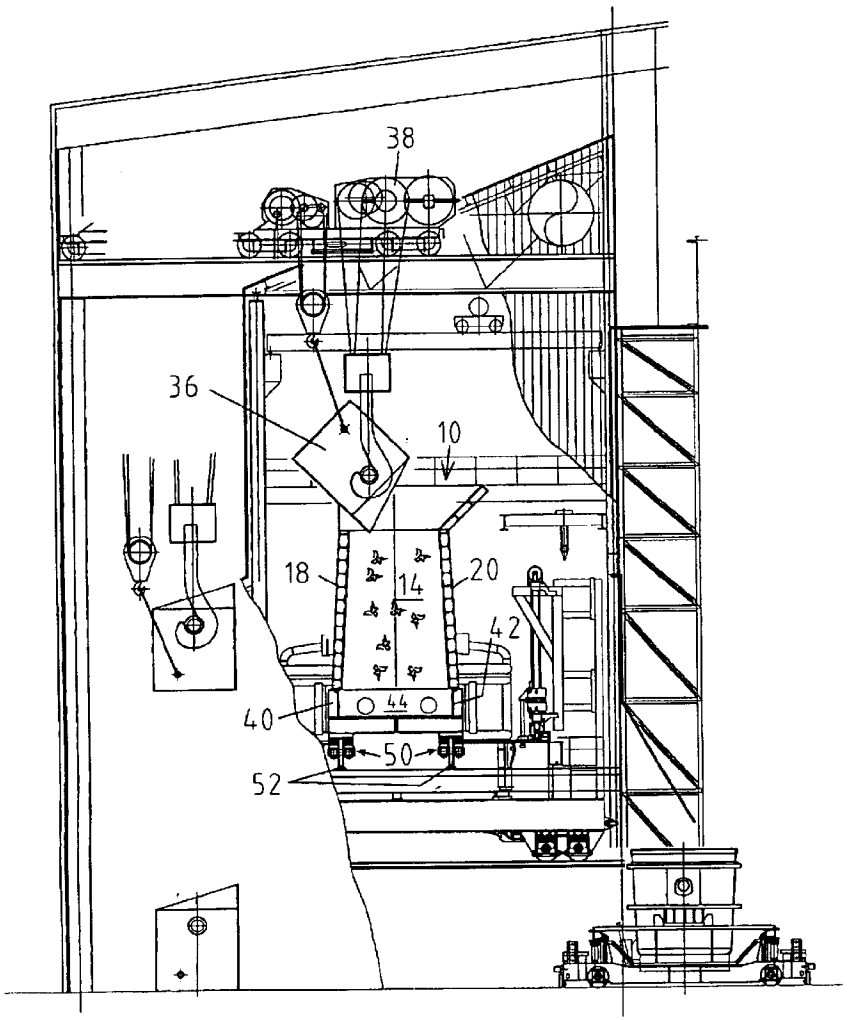
FIG. 2 is a sectional view taken along lines II—II of FIG. 1 and including an associated illustration of an electric arc furnace installation.

FIGS. 1–3 illustrate a first embodiment of a scrap charger 10 incorporating a construction to manipulate scrap for charging a steel-making furnace according to the present invention. The scrap charger 10 essentially includes a scrap holding bunker 12 having a scrap fall space 14 extending to an underlying scrap discharge opening 16. The scrap fall space is bounded by spaced apart side walls 18 and 20 and a front end wall 21 spaced by the scrap discharge opening 16 from a back end wall 24. As shown in FIG. 2, the sidewalls 18 and 20 diverge away from one another in the direction of downward scrap flow along the scrap fall space 14. The downward flow of scrap is also facilitated by an outwardly diverging front wall section 25 providing a laterally offset enlargement to the fall space 14 at the lower terminal portion of the front-end wall 21. The lateral offset provided by the front wall section 25 reduces a possibly of scrap jamming due to impact forces by scrap loading in the scrap fall space above the scrap delivery opening.

The back end wall 24 is made up of wall sections comprised of a vertically extending middle wall portion 26 terminating at an optional outwardly protruding upper wall section 28. Extending downwardly from the middle wall portion 26 is an elongated inclined end wall section 30 sloping horizontally downward to the scrap discharge opening 16 at an acute angle sufficient in magnitude for utilizing, by a resolution of forces, the force of gravity to manipulate scrap components relative to one another during lateral advancing movement along the elongated inclined wall section 30 and thereby promote an orderly organizing of the scrap flowing into the scrap discharge opening 16. The elongated inclined end wall section 30 provides the additional benefit of laterally offsetting the burden of the overlying substantial volume of stored scrap from the scrap discharge opening 16 and thereby reducing the vertical load by the supper-imposed pile of scrap entering the scrap discharge opening 16. This reduced vertical loading promotes layering of the scrap, which beneficially promotes a transition from vertical scrap flow to horizontal scrap flow beneath the scrap discharge opening 16. The horizontal length of the elongated incline end wall section 30 is preferably approximately equal to the horizontal length of the scrap discharge opening 16 but this length relationship is given for only illustrative purposes. Typically the elongated inclined end wall section 30 forms an acute angle of 30° to the horizontal, however, the acute angle may be within the range of 24° and 60°. The elongated inclined wall section 30 facilitate the orientation of long and flat scrap pieces such that the major dimensional axes of such scrap pieces are oriented horizontally as opposed to vertically to better organize the scrap as it enters a pushing space in front of the pusher ram so as to provide for easier pushing and reduced possibilities for scrap jams at the discharge throat of the horizontal scrap discharge opening. The side walls 18 and 20; front end wall 21 and back end wall 24 are formed of face plates 32 welded to a side-by-side arrangement of suitably selected structural shapes 34 that include beams, channels and angles to provide a robust wall construction needed to withstand repeated impact with scrap loaded into the fall space of the scrap holding bunker.

The scrap charger 10 shown in FIG. 1 is supplied with scrap by any of diverse scrap transporting facilities which includes as shown a scrap bucket 36 transported by a over head crane 38 between the scrap charger and a scrap storage facility, not shown. Alternately, the scrap can be carried by rail cars to a skip hoist. Preferably the scrap arrives at an entry site in the fall space 14 of the bunker directly above the elongated inclined end wall section 30. The sidewalls 18 and 20 of the bunker are supported by underlying channel sections 40 and 42, respectively, that extend along opposite lateral sides of a pusher ram 44. The rod ends of side by side piston and cylinder assemblies 44A are secured to a forward end portion of the ram 44 and the cylinder portions of the assemblies 44A are trunnion mounted to gusset plates secured to a floor wall 46 of a support structure that preferably takes the form of a transfer car 48. The floor wall 46 is formed by welding metal plates to support beams extending in a side-by-side relation beneath the channel sections 40 and 42 and supported by pairs of spaced apart wheel assemblies 50 for movement along rails 52 by a piston and cylinder assembly 54. The transfer car is positioned along the rails 52 between an operative position wherein the forward end of a scrap delivery chute 56 is extended through a charging opening of a steel making furnace for charging scrap and an inoperative position wherein the scrap delivery chute 56 is retracted from the steel making furnace to allow freedom of movement of the furnace independently of the scrap charger 10. The forward end of the scrap delivery chute 56 includes a terminal end portion 56A constructed from side by side convolutions of water tight coolant ducts secured by weld and supplied with coolant water to provide thermal protection for terminal end portion 56A when residing in the charging opening of the steel making furnace for charging scrap.

The pusher ram 44 includes sidewalls 60 closely spaced from and guided by the channel sections 40 and 42 for reciprocating movement from a retracted position located beneath the inclined end wall section 30 to allow scrap to pass through the scrap discharge opening 16 into an elongated scrap-receiving trough 58 upstream of the scrap delivery chute 56. The elongated scrap-receiving trough has a width, defined by the space between the channel sections 40 and 42, greater than the width of the scrap discharge opening for using the scrap discharge opening to meter the passage of scrap into the elongated scrap-receiving trough.

A scrap-shoving ram 60 is guided by a guide trough 62 secured to the front end wall section 25 and reciprocated from a retracted position to a downwardly extended position by a piston and cylinder assembly 64 for extending through the scrap discharge opening 16 to push scrap into the scrap receiving trough 58. The scrap-shoving ram 60 is especially useful to maintain a flow of scrap along a scrap jam relief gate 66. The scrap delivery chute 56 has the form of a generally horizontal feed chute section with an enlarged throat opening formed by an elevated roof plate 68 controlled at the throat entrance, identified by reference numeral 70, by the scrap jam relief gate 66 for receiving scrap with a desired and predetermined columnar height from the scrap discharge opening 16. The scrap jam relief gate 66 is formed by feed chute wall section 72 supported at one end by a hinge 74 secured to the elevated roof plate 68 for pivotally carrying a scrap metering bumper 76 at an end opposite to the location of the hinge 74. Piston and cylinder assemblies 78 supported by the end wall 21 is connected to the scrap jam relief gate 66 for displacing the scrap metering bumper 76 between each of an operating position 80A, a relief position 80B and an extended position 80C, the latter two positions being illustrated by phantom lines in FIG. 1. The operating position 80A establishes a desired flow of scrap passing the throat opening 70 from the scrap holding bunker. In the relief position 80B, the scrap-metering bumper 76 is pivotally elevated from the operating position 80A to thereby enlarge the throat entrance and to allow passage of scrap impeded by the pressure relief gate when located in the operating position. The elevated roof plate 68 then forms the limit to the columnar height of scrap passing through the scrap delivery chute 56. The scrap-metering bumper 76 is also used to compact the columnar height of scrap by operating the piston and cylinder assembly 78 to pivotally displace the bumper beyond the operating position 80A into the extended position 80C. As the bumper 76 moves to the extended position 80C, the underlying mass of scrap is compressed against the floor 46 to provide the space needed for reestablishing scrap flow when the bumper 78 is returned to the operating position 80A.

A control valve 82 is operated to supply pressurized hydraulic fluid from a pump 84 to the piston and cylinder assemblies 44A to advance and retract the scrap pusher ram 44. The movement of the ram is continuous between a start position where the leading edge of the ram advances beyond the leading lower edge of the inclined wall section 30 and a stop position where the leading edge of the ram resides beyond the throat entrance 70 to the scrap delivery chute 56. A throttle valve forming part of the control valve 82 in the hydraulic fluid control circuit controls the advancing speed of the ram to charge scrap into the furnace. This ram speed control is particularly useful to control scrap flow based on the melting rate of scrap by the furnace. As the ram is retracted from the stop position along the scrap receiving trough 58 to the start position, there is intended to be a organize flow of scrap into the trough 58 to form another scrap charge for the furnace.

Figure 4:
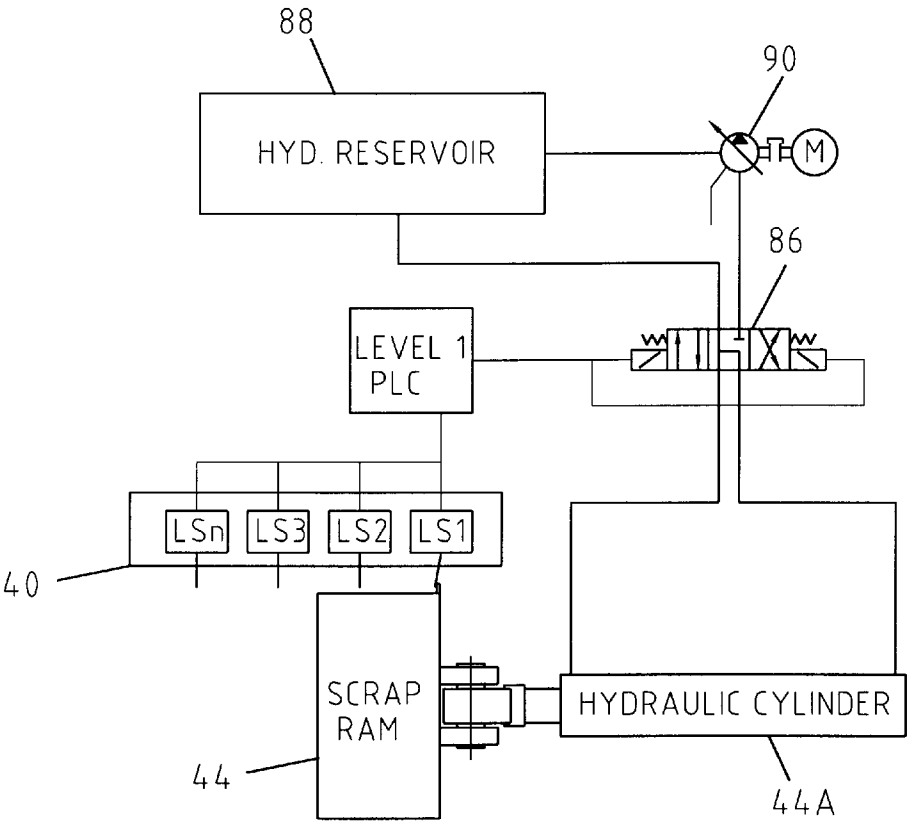
FIG. 4 is a schematic illustration of a modified form of hydraulic control for a scrap-charging ram of the present invention.

The pusher ram can be incrementally moved along the scrap-receiving trough 58 by controlling the operation of the piston and cylinder assemblies 44A to advance a predetermined volume of scrap into the furnace. In this mode of operation, scrap can be charged into the furnace at closely space intervals commencing with the end of the tapping of a heat and extending to a short period, e.g., three minutes, before tapping of the next heat. FIG. 4 schematically illustrates a control for the piston and cylinder assemblies 44A and includes limit switches LS1, LS2, LS3 . . . LSN placed at equally spaced distance intervals along the channel section 40 of the scrap-receiving trough 58. Signals provided by the limit switches are delivered to an actuator for a hydraulic control valve 86 supplied with pressurized hydraulic fluid from a reservoir 88 by a motor driven pump 90. The distance separating the limit switches forms the incremental length of an individual scrap charge. The length of a scrap charge is always less than the distance corresponding to the linear length of the fall space between the end of the scrap deliver chute 56 in the furnace and the vertical wall of an electrode most adjacent the chute. While the limit switches LS1, LS2, LS3 . . . LSN have been selected for the purpose of detecting the advanced positions of the ram, other devices maybe used for this purpose without departing from the present invention. One such form of another device is a detector responsive to displacement of a linear scale by movement of the ram 44.

Figure 5:
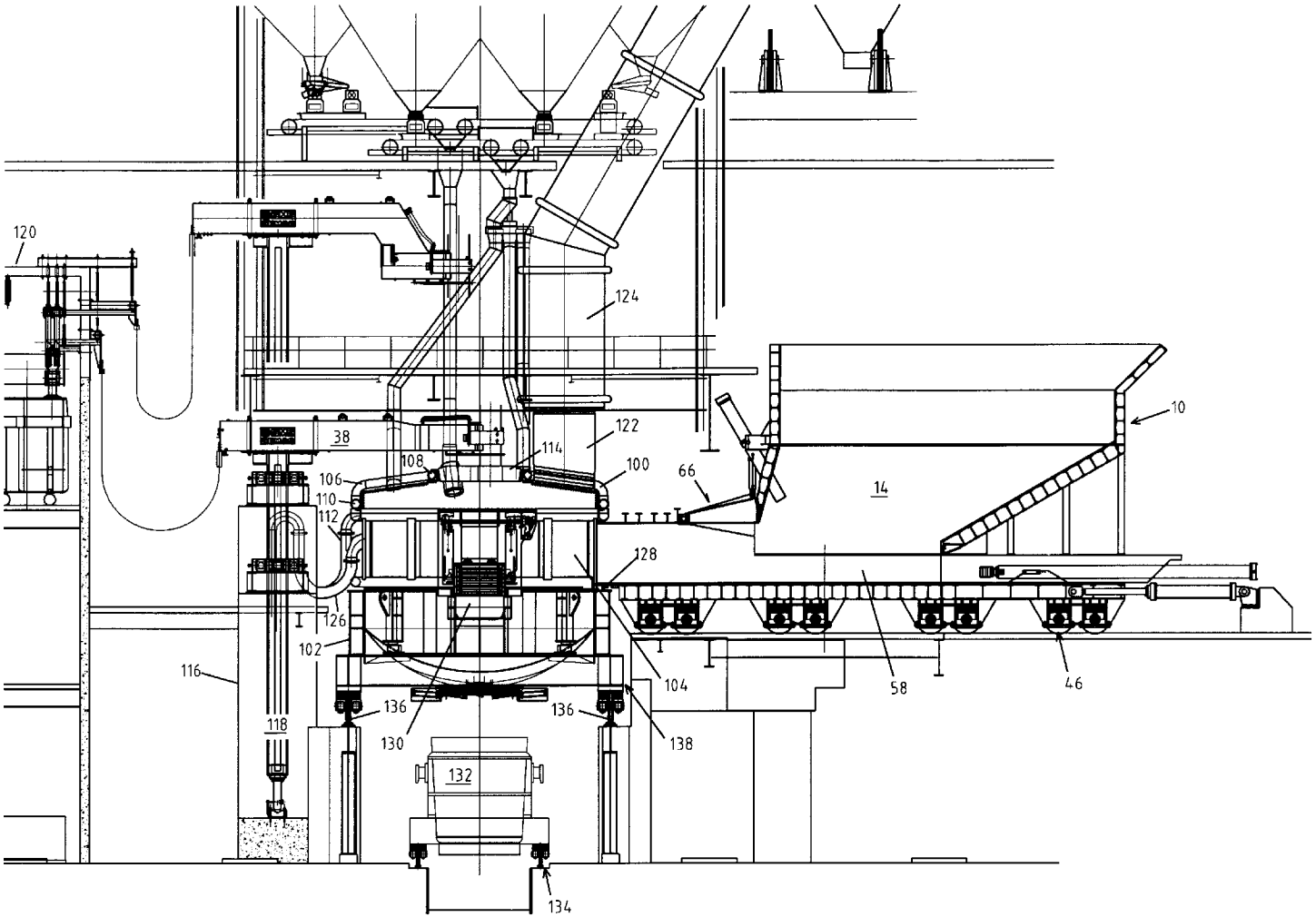
FIG. 5 is a front elevational view of an electric arc furnace installation embodying the features of a scrap charger according to the preferred embodiment of the present invention.
Figure 6:
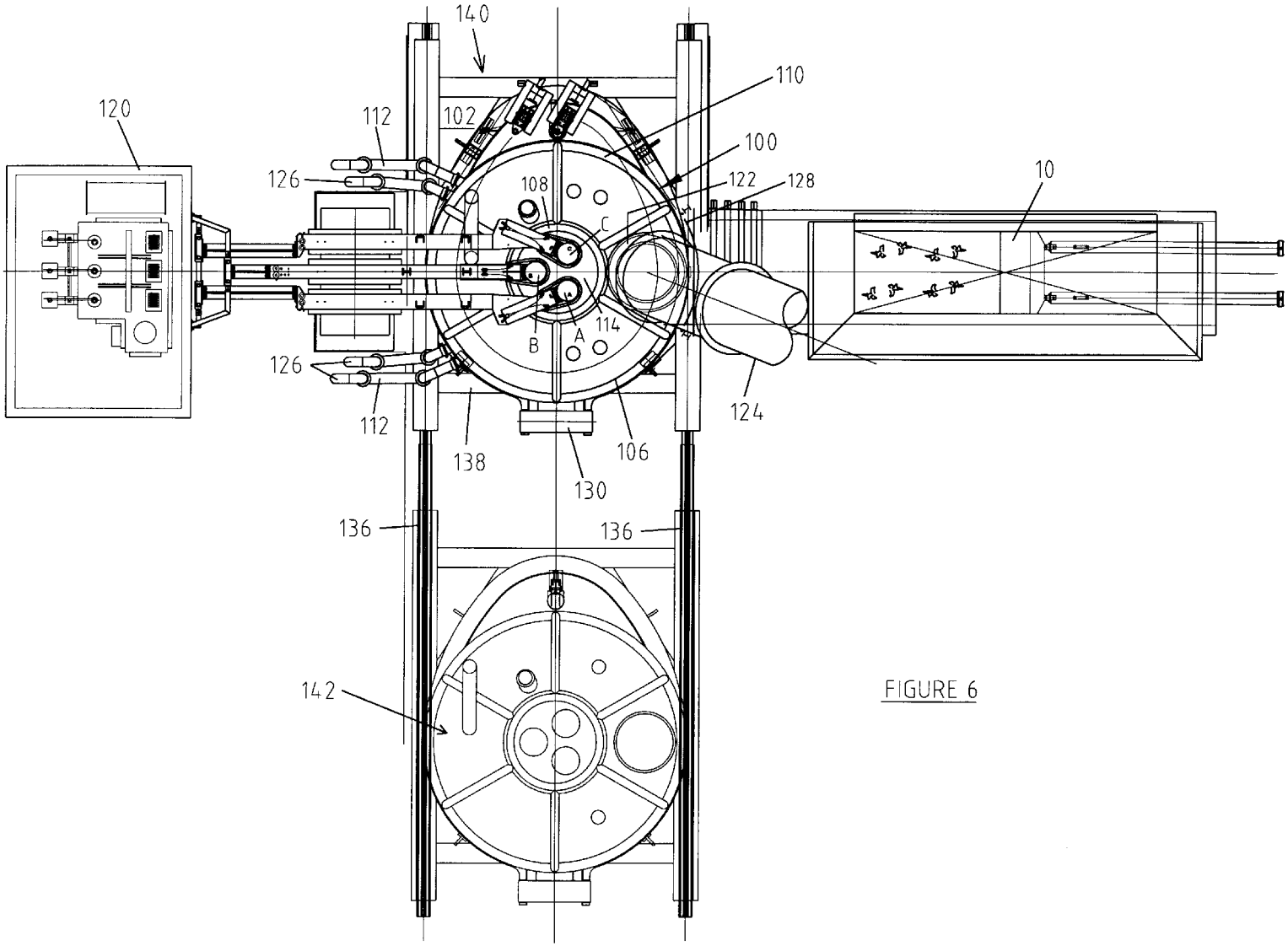
FIG. 6 is a plan view of the electric arc furnace installation shown in FIG. 5.

FIGS. 5 and 6 illustrate one form of a steel making electric furnace facility for use with the scrap charger of the present invention and includes an electric arc furnace 100 formed by a lower furnace shell 102, an upper furnace shell 104 and a furnace roof 106. The furnace roof 106 includes roof panels formed by an array of side-by-side coolant pipes with the coolant passageways communicating with annular upper and lower water supply headers 108 and 110, respectively, interconnected by radial distributing pipes to form a water circulating system communicating with service lines 112 containing water supply and return lines. The service lines include flexible sections to avoid the need to disconnect the service lines when it is desired to lift the furnace roof alone or the furnace roof combined with the upper furnace shell a short distance, e.g., 24 inches, for servicing the lower furnace shell. The upper water supply header 108 encircles a triangular array of three apertures in a roof insert 114. The apertures are dimensional and arranged to accept the phase A, B and C electrodes carried by electrode support arms independently positioned vertically by a support post 116 restrained by horizontally spaced guides in a superstructure for vertical displacement by actuator 118 typical in the form of piston and cylinder assembly. The electrode support arms also support water-cooled cables for transmission of electrical current from transformers in a transformer vault 120 to the respective phase A, B and C electrodes. A fume duct 122 extends vertically from an annular opening in the furnace roof 106 between the upper and lower water supply headers 108 and 110 for exhausting the fume from the interior of the furnace to an enlarged and vertically spaced overlying duct 124 formed by water coolant piping to cool the fume and to provide thermal protection.

The furnace upper shell 104 includes superimposed convolutions of coolant pipes supplied with coolant from spaced apart supply headers that are interconnected by vertical distribution pipes to form a water circulating system communicating with service lines 126 containing water supply and return lines. The coolant pipe of the furnace roof and the coolant pipe of the furnace upper shell may support metal panels for confinement of the fume to the interiors of these furnace components. The service lines 126 include a flexible section to avoid the need to disconnect the service lines when it is desired to lift the furnace roof combined with the upper furnace shell a short distance, e.g., 24 inches, for servicing the lower shell. The convolutions of coolant pipe are arranged to form an annular shape to the upper furnace shell interrupted by a scrap charge opening 128 in one quadrant of the shell. The scrap charge opening 128 is provided to introduce quantities of scrap at desired intervals which can be closely spaced apart by only minutes and extend throughout the major portion of the furnace operating cycle or continuous with uninterrupted scrap flow. The retractable chute is constructed from convolutions of coolant pipes joined together in an edge-to-edge relation. Coolant water is continually circulated through the pipes to prevent destruction while residing in the highly heated environment in the furnace. The extent to which the chute project into the furnace is selected to assure scrap will fall directly into the liquid metal bath and not impact with the refractory of the sidewall. Further, the volume of scrap introduced during each push cycle by the ram is predetermined to prevent damaging impact with electrodes A, B and C and maintain flat bath operation by the furnace.

The scrap residing in a scrap delivery chute 56 serves to prevent unwanted escape of the fume from the furnace into the scrap charger 10. A slag discharge opening is closed by moveable door supported by the upper furnace shell and extending to a slag discharge trough in the lower furnace shell 12. Slag passes from the furnace along the trough beyond a threshold formed by carbon rod insert 130, which is supported by suitable brackets on the lower furnace shell into a slag pot 132 supported by a transfer car moveable along rails 134. Rails 136 extend along opposite sides and above the rails 134 for the transfer car for the slag pot. The rails 136 support a furnace transfer car 138 used to support the lower furnace shell 102 and the upper furnace shell 104 and roof 106 in a superimposed relation. A suitable winch assembly moves the furnace transfer car along the rails 136 from furnace operating position 140 to a furnace exchange position 142. The furnace remains positioned throughout repetitive furnace operating cycles at the furnace operating position 140. The charging of scrap therefore is accomplished by the introduction of scrap through the sidewall of the upper furnace shell although the scrap charger of the present invention is equally useful to charge scrap into an electric arc furnace that tilts in opposite directions for slagging and tapping. In both cases of a tilting furnace arrangement and a static operating arrangement, the charging off scrap maybe accomplished through the top of the furnace after removal of the electrodes and furnace roof.

The electric arc furnace 100 has a configuration of the refractory face surfaces in the lower furnace shell for supporting a metal charge during refining of a steel heat and providing eccentric bottom tapping of the steel heat. At the conclusion of the tapping of the steel heat, there is a liquid heel line formed by the upper surface of the steel heat and represents a reduction to the liquid metal at the start of tapping. The furnace is operated in a manner to always maintain a liquid heel depth, at the end of tapping so that the introduction of scrap into the furnace may be accomplished in an incremental fashion using the thermal energy of the heel and the continuous operation of the electrodes for maintaining flat bath operation. At the conclusion of the tapping of a heat into an underlying ladle one of two transfer stopper assemblies is used to fill the tap hole with sand and promptly thereafter a tap hole gate, not shown, is positioned to close off the bottom of the tap hole assembly.

The furnace remains at the furnace operating position throughout repetitive furnace operating cycles. The charging of scrap therefore is preferably accomplished by the introduction of scrap through the sidewall of the upper furnace shell. The scrap charger of the present invention is equally useful to charge scrap into an electric arc furnace that tilts in opposite directions for slagging and tapping.

Figure 7:
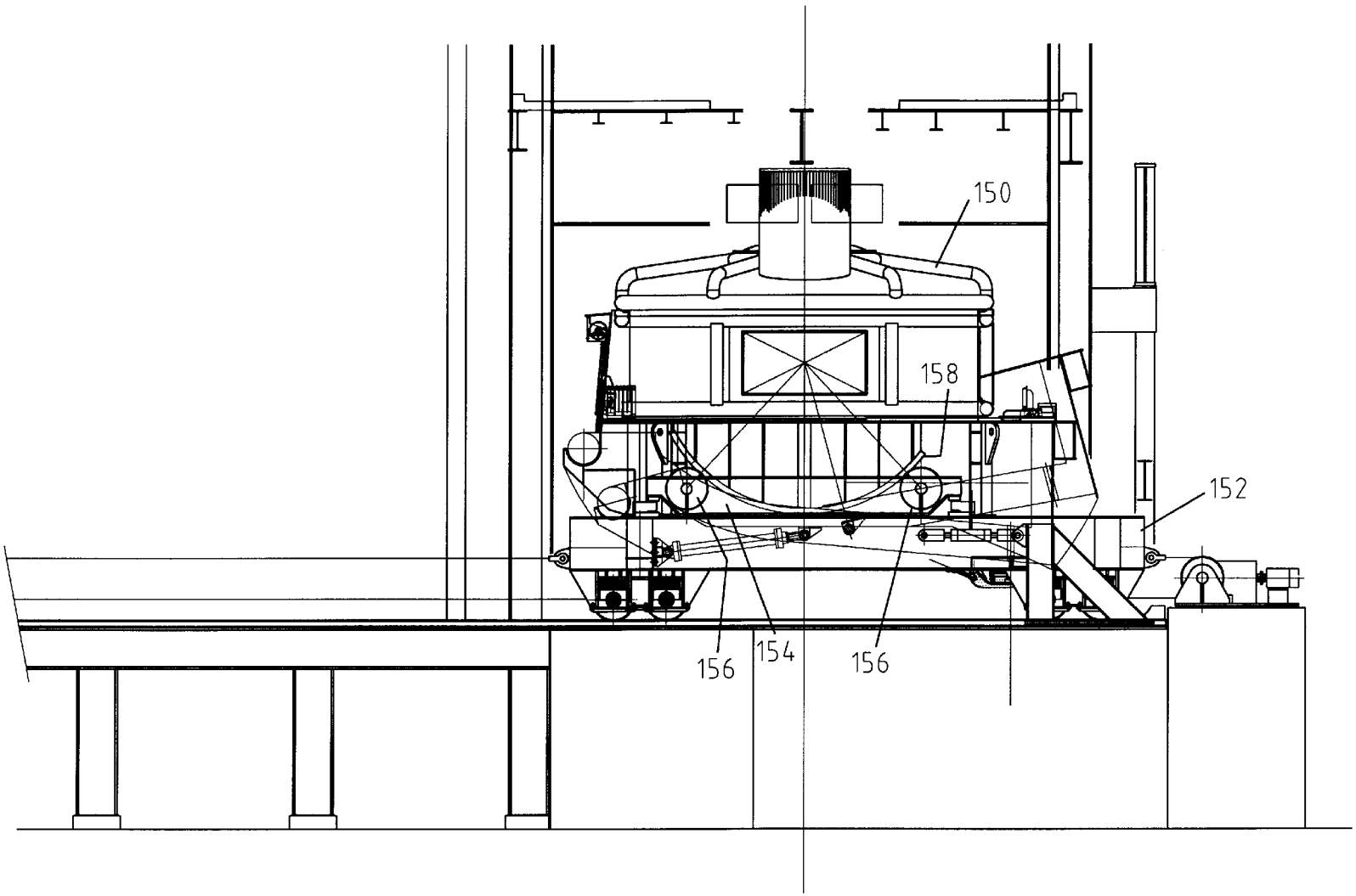
FIG. 7 is a view similar to FIG. 5 and illustrating one embodiment of a tilting furnace for slagging and tapping.

FIG. 7 illustrates an electric arc furnace 150 that is similar to the furnace 100 with the exception of the addition of structure providing pivotal support of the furnace on a furnace transfer car 152. For this purpose, a furnace support frame 154 is provided with spaced apart rollers 156 rotatably supported by suitable bearing assemblies, not shown. The bottom of the lower furnace shell is provided with spaced apart arcuate bars 158 in load bearing contact with the rollers 156. The entire furnace is supported on the furnace transfer car by the rollers 156 whereby the furnace is tilted in opposite directions by operation of a piston cylinder assembly 158 mounted on the furnace transfer car and its rod end clevis mounted to the lower furnace shell. The construction of the furnace in all other respects is the same as shown in FIGS. 5 and 6 and described hereinbefore. However, the present invention is equally applicable to other well-known forms of steel making furnaces. For example, arc-heating furnaces used to heat a metal charge by heat radiation from arcs passed between electrodes above the metal charge. Other furnace designs include an electrically conductive furnace bottom which forms part of an electrical circuit powered by direct current. Induction furnaces can also be installed which operate to heat a metal charge by either using inductors according to a transformer principle where the secondary winding is formed by a loop of liquid metal in a refractory channel or a coreless principle where induction coils surround the furnace wall and generates a magnetic field to impart energy to the metal charge in the furnace.

While the present invention has been described in connection with the preferred embodiments of the various figures, it is to be understood that other similar embodiments may be used or modifications and additions may be made to the described embodiment for performing the same function of the present invention without deviating there from. Therefore, the present invention should not be limited to any single embodiment, but rather construed in breadth and scope in accordance with the recitation of the appended claims.

What is claimed is:

1. A scrap charging apparatus for an electric arc steel making furnace, said scrap charging apparatus including the combination of:

a scrap holding bunker having a scrap fall space extending to an underlying scrap discharge opening;

a scrap delivery chute including a generally horizontal feed chute section having an enlarged throat opening formed by an elevated roof section controlled at the entrance to said enlarged throat opening by a scrap jam relief gate for receiving and passing scrap from said scrap discharge opening, said scrap jam relief gate being displaceable between an operating position establishing a desired columnar height for a flow of scrap passing said throat opening from said scrap holding bunker beyond said throat opening and along said horizontal feed chute section for charging said electric arc steel making furnace and a second position for charging said electric arc steel making furnace by enlarging said enlarged throat opening for passage of scrap beyond said throat opening when impeded by said scrap jam relief gate at said operating position; and a ram controlled by a drive to advance scrap from said scrap discharge opening through said throat opening for delivery from said scrap delivery chute.

2. The scrap charging apparatus according to claim 1 further including an actuator for displacing said scrap jam relief gate to said second position wherein said throat opening is enlarged to allow passage of scrap impeded by said scrap jam relief gate at said operating position.

3. The scrap charging apparatus according to claim 1 further including an actuator for displacing said scrap jam relief gate to an extended position wherein said throat opening is reduced to thereby compact scrap impeded by said scrap jam relief gate at said throat opening.

4. The scrap charging apparatus according to claim 1 further including an actuator for displacing said scrap jam relief gate to an extended position wherein said throat opening is reduced by said scrap jam relief gate when said ram is controlled by said drive to retract from said scrap delivery chute and said scrap discharge opening.

5. The scrap charging apparatus according to claim 1 wherein said scrap delivery chute further includes side walls at opposite sides of a floor wall and a roof wall section, said scrap jam relief gate extending between said roof wall section and said scrap holding bunker, said scrap jam relieve gate having a metering bumper forming an extension to said scrap holding bunker in said scrap delivery chute.

6. A scrap charging apparatus for an electric arc furnace, said scrap charging apparatus including the combination of:

a scrap holding bunker having a scrap fall space extending to an underlying scrap discharge opening;

a scrap delivery chute including a generally horizontal feed chute section having a scrap jam relief gate at a for receiving scrap from said scrap discharge opening, said scrap jam relief gate being displaceable between an operating position establishing a desired flow of scrap passing said throat opening from said scrap holding bunker beyond said throat opening and along said horizontal feed chute section and a second position enlarging said throat opening for passage of scrap beyond said throat opening when impeded by said scrap jam relief gate at said operating position; and a ram controlled by a drive to advance scrap from said scrap discharge opening through said throat opening for delivery from said scrap delivery chute, said scrap holding bunker including a front end wall supporting a scrap shoving ram inclined downward for reorient the scrap in the fall space near said scrap discharge opening at said scrap jam relief gate to reorient the scrap in front of said throat opening and at least reduce the possibility of a scrap jam by scrap entering said scrap discharge opening.

7. A scrap charging apparatus for an electric arc furnace, said scrap charging apparatus including the combination of:

a scrap holding bunker having a scrap fall space extending to an underlying scrap discharge opening, the scrap fall space of said a scrap holding bunker is bounded by spaced apart side walls and a front end wall spaced by said scrap discharge opening from a back end wall, said back end wall essentially including an elongated inclined wall section sloping to the horizontal toward said scrap discharge opening at an acute angle sufficient in magnitude for utilizing the force of gravity to promote lateral advancing movement of scrap along said elongated inclined wall section into said scrap discharge opening and thereby reduce vertical loading on scrap entering said scrap discharge opening, said elongated inclined wall section being sloped at said acute angle to facilitate the orientation of long and flat scrap pieces such that the major dimensional axis is oriented horizontal as opposed to vertical to better organize the scrap entering a pushing space in front of said ram at throat opening;

a scrap delivery chute including a generally horizontal feed chute section having a scrap jam relief gate at a for receiving scrap from said scrap discharge opening, said scrap jam relief gate being displaceable between an operating position establishing a desired flow of scrap passing said throat opening from said scrap holding bunker beyond said throat opening and along said horizontal feed chute section and a second position enlarging said throat opening for passage of scrap beyond said throat opening when impeded by said scrap jam relief gate at said operating position; and a ram controlled by a drive to advance scrap from said scrap discharge opening through said throat opening for delivery from said scrap delivery chute.

8. The scrap charging apparatus according to claim 7 wherein said scrap discharge chute includes an elongated scrap receiving trough underlying said scrap delivery opening, said elongated scrap receiving trough having a width greater than the width of said scrap discharge opening for using said scrap discharge opening to meter the passage of scrap into said elongated scrap receiving trough.

9. A scrap charging apparatus for an electric arc furnace, said scrap charging apparatus including the combination of:

a scrap holding bunker having a scrap fall space extending to an underlying scrap discharge opening;

a scrap delivery chute including a generally horizontal feed chute section having a scrap jam relief gate at a for receiving scrap from said scrap discharge opening, said scrap jam relief gate being displaceable between an operating position establishing a desired flow of scrap passing said throat opening from said scrap holding bunker beyond said throat opening and alone said horizontal feed chute section and a second position enlarging said throat opening for passage of scrap beyond said throat opening when impeded by said scrap jam relief gate at said operating position;

a transport vehicle for supporting said scrap delivery chute for movement between a scrap charging position wherein said horizontal feed chute section extends through a charging opening of an electric arc furnace and an inoperative position wherein said horizontal feed chute section is withdrawn from said charging opening for tapping, tilting or removal of the electric arc furnace;

a structure for supporting said transport vehicle at a lateral spaced location from the electric arc furnace; and a ram controlled by a drive to advance scrap from said scrap discharge opening through said throat opening for delivery from said scrap delivery chute.

10. A scrap charging apparatus for an electric arc furnace, said scrap charging apparatus including the combination of:

a scrap holding bunker having a scrap fall space bounded by spaced apart side walls and a front end wall spaced by a scrap discharge opening from a back end wall and said back end wall essentially including an elongated inclined wall section sloping horizontally downward toward said scrap discharge opening at an acute angle sufficient in magnitude for utilizing the force of gravity to promote lateral advancing movement of scrap along said elongated inclined wall section into said scrap discharge opening and thereby reduce vertical loading on scrap entering said scrap discharge opening, said elongated inclined wall section being sloped at said acute angle to laterally offset the burden of an overlying substantial volume of stored scrap from said scrap discharge opening and facilitate the orientation of long and flat scrap pieces such that the major dimensional axis is oriented horizontal as opposed to vertical to better organize the scrap entering said scrap discharge opening and promote layering of the scrap at a transition from vertical scrap flow to horizontal scrap flow beneath said scrap discharge opening;

a scrap delivery chute including a generally horizontal elongated feed chute section extendable through a charging opening of said electric arc furnace for charging of scrap received from said scrap discharge opening; and a ram controlled by a drive to advance scrap from said scrap delivery chute into the electric arc furnace.

11. The scrap charging apparatus according to claim 10 wherein said scrap delivery chute includes an elongated scrap receiving trough underlying said scrap discharge opening, said elongated scrap receiving trough having a width greater than the width of said scrap discharge opening for using said scrap discharge opening to meter the passage of scrap into said elongated scrap receiving trough.

12. The scrap charging apparatus according to claim 10 wherein said sidewalls diverge toward said scrap discharge opening for promoting a flow of scrap along said fall space.

13. The scrap charging apparatus according to claim 10 wherein said elongated inclined wall section sloping horizontally downward toward said scrap discharge opening comprises an extension of said back wall.

14. The scrap charging apparatus according to claim 10 wherein said front end wall diverges outwardly to progressively enlarge said scrap discharge opening downwardly and reduce scrap jamming loading due to scrap loading impact forces on scrap in said scrap fall space above said scrap discharge opening.

15. The scrap charging apparatus according to claim 10 wherein said an elongated inclined wall section slopes horizontally downward toward said scrap discharge opening at an acute angle of at least 24°.

16. The scrap charging apparatus according to claim 10 wherein said horizontal feed chute section includes a scrap jam relief gate at a throat opening for receiving scrap from said scrap discharge opening, said scrap jam relief gate being displaceable between an operating position establishing a desired flow of scrap passing said throat opening from said scrap holding bunker and a relief position enlarging said throat opening to allow passage of scrap impeded by said scrap jam relief gate at said operating position, and wherein said scrap charging apparatus further includes a transport vehicle supporting said scrap delivery chute for movement between a scrap charging position wherein said generally horizontal elongated feed chute section extends through a charging opening into an electric arc furnace and an inoperative position wherein said horizontal elongated feed chute section is withdrawn from said charging opening for taping of the electric arc furnace, and a structure for supporting said transport vehicle at a lateral spaced location from the electric arc furnace.

17. The scrap charging apparatus according to claim 7 wherein scrap delivery chute includes an elongated scrap receiving trough underlying said scrap discharge opening, said elongated scrap receiving trough being bounded at opposite lateral sides by structural support members spaced apart at a distance greater than the width of said scrap discharge opening for using said scrap discharge opening to meter the passage of scrap into said elongated scrap receiving trough, said scrap holding bunker being supported by said structural support members, and wherein said scrap charging apparatus further includes a transport vehicle supporting said structural support members for movement along parallel rails forming part of structure for supporting said transport vehicle at a laterally spaced location from said electric arc furnace.

18. The scrap charging apparatus according to claim 14 further including a scrap jam relief gate between said scrap delivery chute and said scrap discharge opening.

* * * * *